US007734398B2

(12) United States Patent
Manneppalli

(10) Patent No.: US 7,734,398 B2
(45) Date of Patent: Jun. 8, 2010

(54) SYSTEM FOR AUTOMATED EXCAVATION CONTOUR CONTROL

(75) Inventor: Swaroop Sesha Kamala Manneppalli, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 187 days.

(21) Appl. No.: 11/495,772

(22) Filed: Jul. 31, 2006

(65) Prior Publication Data

US 2008/0082238 A1 Apr. 3, 2008

(51) Int. Cl.
*G06F 19/00* (2006.01)

(52) U.S. Cl. ..... 701/50; 37/414; 37/348; 172/2

(58) Field of Classification Search ..... 701/50; 37/348, 415, 414; 73/146; 172/2; 342/357.06, 342/357.17, 451; *G06F 19/00*
See application file for complete search history.

(56) References Cited

U.S. PATENT DOCUMENTS 4,081,033 A 3/1978 Bulger et al.
5,005,652 A * 4/1991 Johnson ..... 172/1
5,065,326 A * 11/1991 Sahm ..... 701/50
5,174,385 A 12/1992 Shinbo et al.
5,178,510 A 1/1993 Hanamoto et al.
5,356,259 A 10/1994 Hanamoto et al.
5,493,798 A 2/1996 Rocke et al.
5,560,431 A 10/1996 Stratton
5,682,312 A 10/1997 Rocke
5,854,988 A * 12/1998 Davidson et al. ..... 701/50
5,875,854 A * 3/1999 Yamamoto et al. ..... 172/4.5
5,924,493 A 7/1999 Hartman et al.
5,941,921 A * 8/1999 Dasys et al. ..... 701/50
5,953,838 A * 9/1999 Steenwyk ..... 37/348
5,968,103 A * 10/1999 Rocke ..... 701/50
5,974,352 A * 10/1999 Shull ..... 701/50
6,076,029 A * 6/2000 Watanabe et al. ..... 701/50
6,098,322 A 8/2000 Tozawa et al.
6,191,732 B1 * 2/2001 Carlson et al. ..... 342/357.06
6,247,538 B1 6/2001 Takeda et al.
6,282,477 B1 * 8/2001 Gudat et al. ..... 701/50
6,345,231 B2 * 2/2002 Quincke ..... 701/213
6,363,632 B1 * 4/2002 Stentz et al. ..... 37/414
6,655,465 B2 * 12/2003 Carlson et al. ..... 172/4.5
6,845,311 B1 * 1/2005 Stratton et al. ..... 701/50
6,879,899 B2 4/2005 Budde
6,931,772 B2 8/2005 Furuno et al.
6,968,241 B2 11/2005 Vonnoe et al.
7,216,033 B2 * 5/2007 Flann et al. ..... 701/202
7,228,214 B2 * 6/2007 Flann et al. ..... 701/50
7,490,678 B2 * 2/2009 Unruh et al. ..... 172/2

(Continued)

FOREIGN PATENT DOCUMENTS

EP 1 099 802 5/2001

(Continued)

*Primary Examiner*—Tuan C To
(74) *Attorney, Agent, or Firm*—Finnegan, Henderson, Farabow, Garrett & Dunner

(57) ABSTRACT

A control system for a machine is disclosed. The control system has a ground engaging tool operable to remove material from a surface at a worksite. The control system also has a controller configured to generate a desired single-pass excavation contour prior to engagement of the ground engaging tool with the surface. The desired single-pass excavation contour has one or more predefined characteristics.

17 Claims, 3 Drawing Sheets

U.S. PATENT DOCUMENTS

| | | | | |
|---|---|---|---|---|
| 7,509,198 | B2 * | 3/2009 | Shull et al. | 701/50 |
| 2004/0024510 | A1 * | 2/2004 | Finley et al. | 701/50 |
| 2005/0131610 | A1 | 6/2005 | Sahm et al. | |

FOREIGN PATENT DOCUMENTS

| | | |
|---|---|---|
| GB | 2 228 507 | 8/1990 |
| JP | 57112525 | 7/1982 |

* cited by examiner

SYSTEM FOR AUTOMATED EXCAVATION CONTOUR CONTROL

TECHNICAL FIELD

The present disclosure relates generally to an automated machine control system and, more particularly, to a system for automatically calculating and controlling a machine's excavation contour.

BACKGROUND

Machines such as, for example, dozers, motor graders, wheel loaders, and other types of heavy equipment are used to perform a variety of tasks. Some of these tasks require very precise and accurate control over operation of the machine that is difficult for an operator to provide. Other tasks requiring removal of large amounts of material can be difficult for an unskilled operator to achieve efficiently. Poor performance and low efficiency can be costly to a machine owner. Because of these factors, the completion of some tasks by a completely operator-controlled machine can be expensive, labor intensive, time consuming, and inefficient.

One method of improving the operation of a machine under such conditions is described in U.S. Pat. No. 5,005,652 (the '652 patent) issued to Johnson on Apr. 9, 1991. The '652 patent describes a track laying vehicle carrying a bulldozer blade, which can be raised or lowered by a pair of hydraulic rams. The rams are under the control of a control system carried on the vehicle. The blade carries an upwardly extending mast having a laser beam detector for receiving signals emitted by a laser-formed reference plane. In use, the track laying vehicle can be driven forward while the signal from the laser-formed reference plane is received by the detector. The detector determines whether a locus of the detector, the blade, and hence the profile of the work surface being produced are deviating from a required datum. Upon detection of a deviation, the control system provides hydraulic control of the rams such that the detector, blade, and the cut surface are returned to the correct elevation parallel to the reference plane.

To produce a non-planar surface, a distance wheel may be mounted to the tracked vehicle of the '652 patent to give a distance measurement from a starting point. During operation, the blade can be traversed in a direction generally parallel to the reference plane while varying the distance of the blade from the reference plane in accordance with instructions from the control system. The instructions are issued by the control system in accordance with the distance measurement transmitted to it by the distance wheel and a desired contour.

Although the track laying vehicle of the '652 patent may be capable of producing accurate surface contours during an excavation process, it may not consider efficiency when doing so. In particular, the control system associated with the track laying vehicle does not consider an amount of material being moved during each excavation pass, a condition of the material, a capacity of the track laying vehicle to move the material, or a resulting intermediate contour (e.g., the contour of the surface after a first excavation pass, but prior to a final excavation pass). Instead, the control system of the '652 patent is only capable of blindly following a predefined contour map and, typically, is only used for final grading operations. For this reason, the track laying vehicle of the '652 patent may be inefficient at producing the desired surface contour and at moving large amounts of material that require multiple excavation passes.

The disclosed system is directed to overcoming one or more of the problems set forth above.

SUMMARY OF THE INVENTION

In one aspect, the present disclosure is directed to a control system for a machine. The control system includes a ground engaging tool operable to remove material from a surface at a worksite. The control system also includes a controller configured to generate a desired single-pass excavation contour prior to engagement of the ground engaging tool with the surface. The desired single-pass excavation contour has one or more predefined characteristics.

In yet another aspect, the present disclosure is directed to a method of controlling a machine's work implement. The method includes generating a desired excavation contour in a work surface based on a mathematical curve. The method further includes controlling the position of the work implement to produce the desired excavation contour.

DETAILED DESCRIPTION

Figure 1:
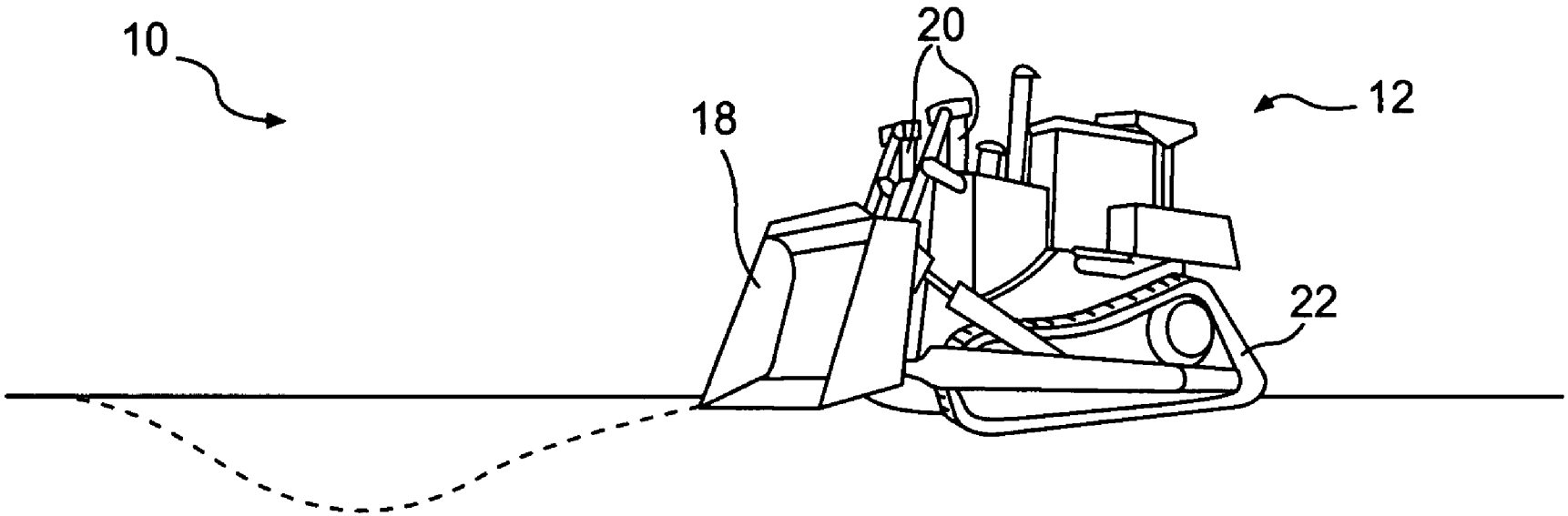
FIG. 1 is a pictorial illustration of an exemplary disclosed machine operating at a worksite.

FIG. 1 illustrates a worksite 10 with an exemplary machine 12 performing a predetermined task. Worksite 10 may include, for example, a mine site, a landfill, a quarry, a construction site, or any other type of worksite. The predetermined task may be associated with altering the current geography at worksite 10 and may include, for example, a grading operation, a leveling operation, a bulk material removal operation, or any other type of geography altering operation at worksite 10.

Machine 12 may embody a mobile machine that performs some type of operation associated with an industry such as mining, construction, farming, or any other industry. For example, machine 12 may be an earth moving machine such as a dozer having a blade or other work implement 18 movable by way of one or more motors or cylinders 20. Machine 12 may also include one more traction devices 22, which may function to steer and/or propel machine 12.

Figure 2:
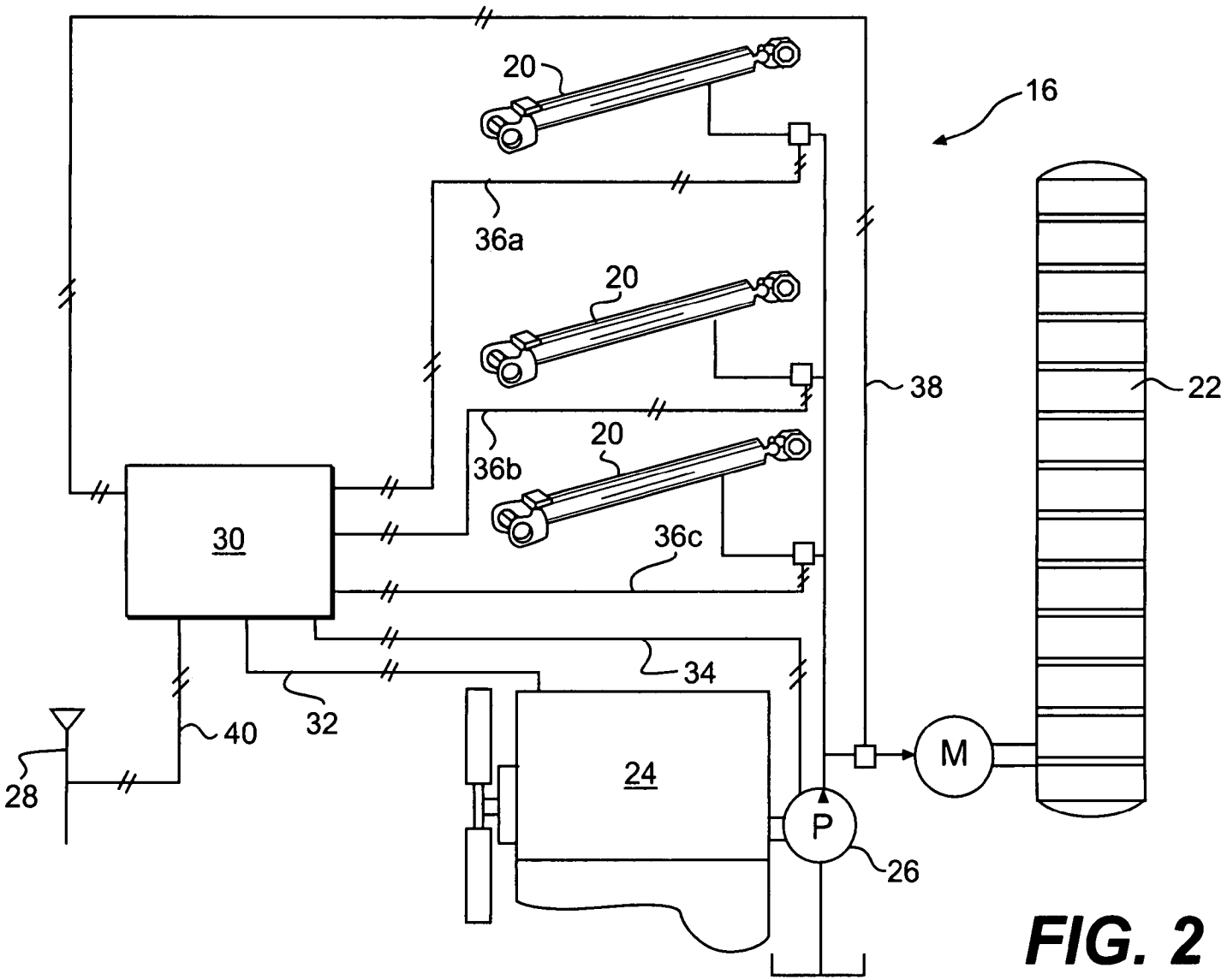
FIG. 2 is a diagrammatic illustration of an exemplary disclosed control system for use with the machine of FIG. 1.

As best illustrated in FIG. 2, machine 12 may include a control system 16 in communication with components of machine 12 to affect the operation of machine 12. In particular, control system 16 may include a power source 24, a means 26 for driving cylinders 20 and traction device 22, a locating device 28, and a controller 30. Controller 30 may be in communication with power source 24, driving means 26, cylinders 20, traction device 22, and locating device 28 via multiple communication links 32, 34, 36*a-c*, 38, and 40, respectively.

Power source 24 may embody an internal combustion engine such as, for example, a diesel engine, a gasoline engine, a gaseous fuel powered engine, or any other type of engine apparent to one skilled in the art. Power source 24 may alternatively or additionally include a non-combustion source of power such as a fuel cell, a power storage device, an electric motor, or other similar mechanism. Power source 24 may be connected to drive means 26 via a direct mechanical coupling, an electric circuit, or in any other suitable manner.

Driving means 26 may include a pump such as a variable or fixed displacement hydraulic pump drivably connected to power source 24. Driving means 26 may produce a stream of pressurized fluid directed to cylinders 20 and/or to a motor associated with traction device 22 to drive the motion thereof. Alternatively, driving means 26 could embody a generator configured to produce an electrical current used to drive any one or all of cylinders 20 and traction device 22, a mechanical transmission device, or any other appropriate means known in the art.

Locating device 28 may be associated with work implement 18 to determine a position of work implement 18 relative to machine 12 or, alternatively, to a local reference point or coordinate system associated with work site 10. For example, locating device 28 may embody an electronic receiver configured to communicate with one or more satellites (not shown) or a local radio or laser transmitting system to determine a relative location of itself. Locating device 28 may receive and analyze high-frequency, low power radio or laser signals from multiple locations to triangulate a relative 3-D position. A signal indicative of this position may then be communicated from locating device 28 to controller 30 via communication link 40. Alternatively, locating device 28 may embody an Inertial Reference Unit (IRU), a position sensor associated with cylinders 20 and/or traction device 22, or any other known locating device operable to receive or determine positional information associated with machine 12.

Controller 30 may include means for monitoring, recording, storing, indexing, processing, and/or communicating the location of machine 12 and for automatically controlling operations of machine 12 in response to the location. These means may include, for example, a memory, one or more data storage devices, a central processing unit, or any other components that may be used to run the disclosed application. Furthermore, although aspects of the present disclosure may be described generally as being stored in memory, one skilled in the art will appreciate that these aspects can be stored on or read from different types of computer program products or computer-readable media such as computer chips and secondary storage devices, including hard disks, floppy disks, optical media, CD-ROM, or other forms of RAM or ROM.

Controller 30 may be configured to generate a desired excavation contour based on a mathematical curve, one or more inputs associated with characteristics of worksite 10, and a capacity of machine 12. For example, controller 30 may use a Gaussian curve represented by Eq. 1 below to calculate a desired trajectory of work implement 18 during a single excavation pass.

$$y = Ae^{-\left(\frac{x-\mu}{\sigma}\right)^n} \qquad \text{Eq. 1}$$

wherein:

- y is a vertical depth of cut below the work surface;
- A is a variable that limits the maximum depth of cut;
- x is the horizontal travel distance along the work surface;
- μ is a variable associated with a horizontal location of the maximum dept of cut;
- σ is a variable associated with a rate of change of the excavation contour slope; and
- n is another variable that can affect the rate of change of the excavation contour slope.

When generating the Gaussian curve from Eq. 1 above, controller 30 may select the variables μ, σ, and n based on a condition of worksite 10. In particular, one or more maps relating an operating slope of machine 12, a material composition of worksite 10, a viscosity of worksite 10, or other such worksite-associated condition to the variables μ, σ, and n may be stored in the memory of controller 30. Each of these maps may include a collection of data in the form of tables, graphs, and/or equations. In one example, the material condition of a worksite surface and the variable μ may form the coordinate axis of a 2-D table for control of the horizontal location of the maximum depth of cut. In another example, the existing general slope of the surface and the variable σ may form the coordinate axis of another 2-D table for control of the entry and/or exit slopes of the excavation contour. Although in most situations n may be an even number, such as 2, n may alternatively be related to slope and/or the material condition (i.e., hardness) of the surface in yet another 2-D table to affect the entry and/or exit slopes of the excavation contour. It is contemplated that a set of μ-relationship tables, a set of σ-relationship tables, and/or a set of n relationship tables may be stored in the memory of controller 30. In this situation, each table within each set may correspond to a machine condition such as, for example, a speed of machine 12, an available power output of machine 12, an attached work implement type, or other similar machine condition. Controller 30 may allow the operator to directly modify these maps and/or to select specific maps from available relationship maps stored in the memory of controller 30 to affect the variables μ, σ, and n based on observed conditions at worksite 10 or specific modes of machine operation. It is contemplated that the maps may alternatively be automatically selected for use and/or modified by controller 30 based on measured parameters such as, for example, slip, drawbar pull, stall, travel speed, or other similar parameters indicative of conditions at worksite 10.

Once the variables μ, σ, and n have been selected for use in determining the desired excavation contour based on material and/or machine conditions specific to the current worksite, the variable A may be determined based on a capacity of machine 12. In particular, machine 12 may have a maximum capacity to move material that is fixed according to a size of work implement 18, a maximum drawbar pull force of machine 12, a travel speed of machine 12, or other such machine-related limitation. Controller 30 may compare the desired excavation contour to the capacity of machine 12 and modify the value of the variable A based on the capacity such that a maximum volume of material is removed during each excavation pass, without exceeding the machine's capacity to efficiently move material along the work surface. In one example, the maximum volume of material removed during each excavation pass may be limited to less than about 80% of a fixed blade load. This condition may be represented by the following equation:

$$W_{implement}\int Ae^{-\left(\frac{x-\mu}{\sigma}\right)^n} \leq .8C_{machine} \qquad \text{Eq. 2}$$

wherein:

$W_{implement}$ is the width of work implement 18;

$\int Ae^{-\left(\frac{x-\mu}{\sigma}\right)^n}$ is the excavation volume below the work surface; and $C_{machine}$ is the maximum capacity of machine 12 to move material along the work surface.

When generating the desired excavation contour, other limitations on the variables of Eq. 1 may also be implemented based on a capacity of machine 12. For example, the value of the variable σ may be limited to a minimum threshold value corresponding to a maximum slope rate of change possible with machine 12. In this manner, only contours that are possible for machine 12 to follow may be generated.

When implementing Eq. 1 from above, the generated excavation contour may also be constrained to positively affect future excavation passes. In particular, optimal entry and exit slopes of the excavation contour may be substantially tangential to the work surface such that abrupt changes in the terrain, which can slow production of machine 12, are minimized. The nature of the Gaussian curve may provide these tangential entry and exits slopes. Curves other than Gaussian-type curves may also provide for this requirement. These other mathematical curves may include, among others, trigonometric curves such as a sin or a tangent curve, a clothoid loop, or segments of a spiral.

Controller 30 may control cylinders 20 and/or traction devices 22 to automatically alter the geography of worksite 10. In particular, controller 30 may automatically control operations of machine 12 to engage work implement 18 with the terrain of worksite 10 at the calculated excavation entry location and slope, move work implement 18 along the trajectory of the determined Gaussian curve, and remove work implement 18 from the work surface at the appropriate exit location and slope. Controller 30 may be in communication with the actuation components of cylinders 20 and/or traction device 22 to raise, lower, and/or orient machine 12 and work implement 18 such that work implement 18 produces the desired excavation contour. For example, controller 30 may communicate with power source 24, driving means 26, with various hydraulic control valves associated with cylinders 20, with transmission devices (not shown), and/or other actuation components of machine 12 to initiate, modify, or halt operations of cylinders 20 and traction device 22, as necessary or desired. It is contemplated that controller 30 may use locating device 28 and/or other such guidance and implement positioning systems to accurately control the operation of machine 12 such that work implement 18 follows the calculated trajectory of the Gaussian curve. In this manner, controller 30 may provide for partial or full automatic control of machine 12. It is contemplated that controller 30 may only determine the desired excavation contour, then relinquishing control of machine 12 to an operator, if desired. It is also contemplated that controller 20 may be located remotely from machine 12, and only transmit the desired contour to machine 12.

Figure 3:
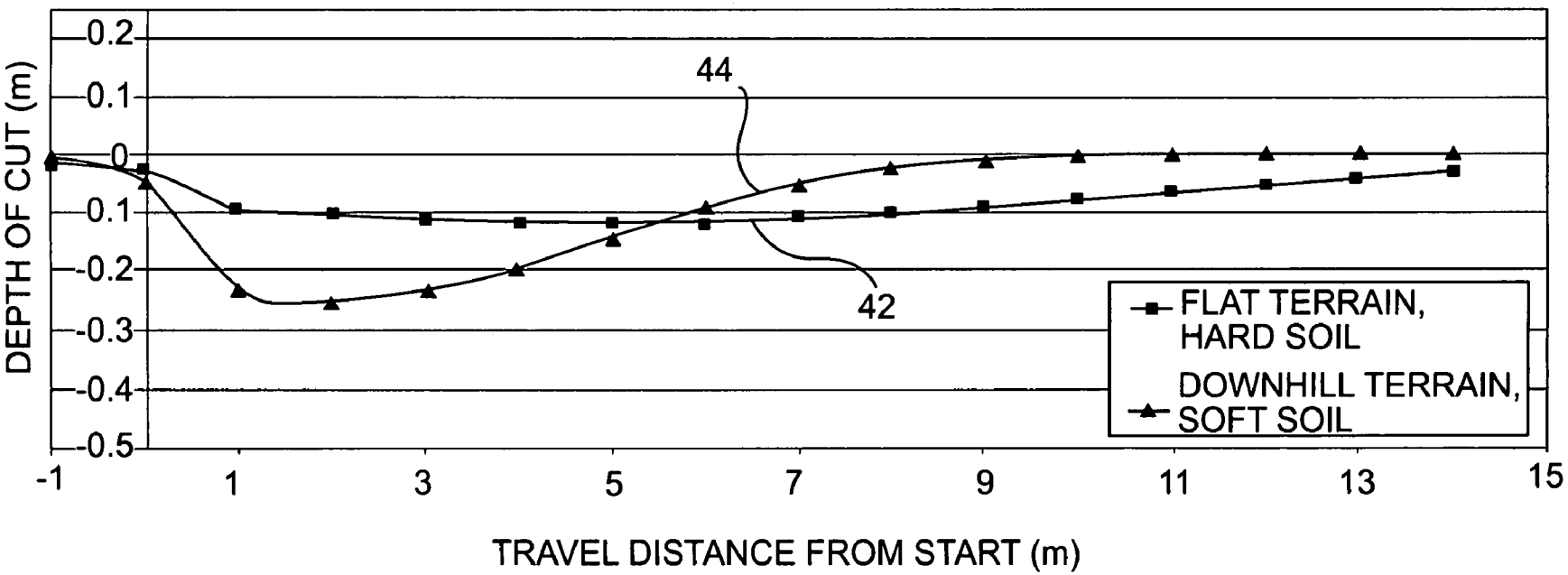
FIG. 3 is a diagrammatic illustration of exemplary excavation contours generated by the control system of FIG. 2.

FIG. 3 provides example Gaussian curves calculated for different worksite conditions. FIG. 3 will be discussed in more detail in the follow section to further illustrate the disclosed control system and its operation.

INDUSTRIAL APPLICABILITY

The disclosed control system may be applicable to machines performing material moving operations where efficiency is important. In particular, the disclosed control system may, based on a mathematical curve and one or more machine/worksite related conditions, determine a desired excavation contour that results in the efficient removal of earthen material. The disclosed control system may then automatically control a work implement of the machine and the machine itself to closely follow the excavation contour such that efficient removal of the material is achieved. The operation of control system 16 will now be described.

FIG. 3 illustrates two exemplary excavation contours 42 and 44, which were determined based on Gaussian curves according to Eq. 1. In the first example, contour 42 may be associated with machine 10 operating on flat terrain (represented by the horizontal line at y=0) of hard material. Because of the hardness of the material and a known capacity of machine 10, σ on entry was set to 4 m resulting in a gentle entry slope, σ on exit was set to 8 m resulting in an even more gentle exit slope to accommodate a loaded work implement 18, μ was set for a maximum depth at 5 m from the start of the excavation contour, n was set to the standard value of 2, and A was thereafter determined to be a fairly shallow depth of 12 cm based on the limited capacity of machine 12 in the hard terrain. As indicated above, the amount of material that will be excavated during the pass along contour 42 may be less than about 80% of the maximum blade load of machine 10.

In the example illustrated by contour 44, machine 10 is operating on downhill terrain (rotated to align with the horizontal line at y=0 for comparison purposes) of soft material. Because of the slope and the softness of the material, machine 10 may be capable of more aggressive excavation (e.g., a more aggressive cut to a deeper depth resulting in faster loading of machine 10). For this reason, σ on entry was set to 1.5 m resulting in a steep forceful entry slope, σ on exit was set to 4 m resulting in a more gentle slope to accommodate a loaded work implement 18, μ was set for a maximum depth at 2 m from the start of the excavation contour for quick loading of the soft material by work implement 18, n remained at the standard value of 2, and A was thereafter set to a depth of 25 cm corresponding to the limited capacity of machine 10 in the soft surface material. Similar to excavation contour 42, the amount of material that will be excavated during the pass along contour 42 may be kept to less than about 80% of the maximum blade load of machine 10.

From the two examples described above, some general trends may be observed. In particular, the depth of the desired excavation contour may increase as the general slope of the work surface decreases. That is, as the slope of the terrain decreases from uphill to flat or from flat to downhill, gravity may act on machine 10 to increase its capacity to move material. This increased capacity may be utilized by increasing the depth of the excavation contour. Similarly, a depth of the desired excavation contour may increase as the material of the work surface softens, because the capacity of the machine to break into and move the material may increase. As the depth of the desired excavation contour increases, a length of the desired excavation contour may decrease in order to remain within the capacity limitations of machine 10. That is, as the depth of an excavation contour increases, the length may decrease to keep the amount of removed material to less than the 80% mark. Similar trends may also be observed according to machine speed prior to excavation entry, wherein a higher initial speed results in a greater capacity to break into and move material.

Because controller 30 may consider machine capacity and worksite conditions when determining excavation contours, it may be efficient at removing large amounts of material from worksite 10. In particular, because the excavation contours may be based on machine capacity such as speed, drawbar pull, and size and based on worksite conditions such as slope and material softness, the excavation contours may correspond with a maximum amount of material removable by machine 12 during a single excavation pass. By ensuring that machine 12 is not unnecessarily over or under loaded, machine 12 may be operated at peak efficiency. In addition, because controller 30 may consider the predicted efficiency of machine 12 through subsequent excavation passes, each pass of machine 12 may be optimally efficient.

It will be apparent to those skilled in the art that various modifications and variations can be made to the disclosed control system. Other embodiments will be apparent to those skilled in the art from consideration of the specification and practice of the disclosed control system. It is intended that the specification and examples be considered as exemplary only, with a true scope being indicated by the following claims and their equivalents.

What is claimed is:

1. A control system for a machine, comprising:

a ground engaging tool operable to remove material from a surface at a worksite; and a controller configured to receive at least one input associated with a condition of the worksite and to generate a desired single-pass excavation contour prior to engagement of the ground engaging tool with the surface, the desired single-pass excavation contour based on a mathematically derived curve that is modified by a capacity of the machine and the condition of the worksite;

the controller further configured to control positioning of the ground engaging tool to follow the single-pass excavation contour.

2. The control system of claim 1, wherein the desired single-pass excavation contour is a complete trajectory of the tool including an entry into, movement through, and an exit from the surface.

3. The control system of claim 1, wherein:

the controller generates the desired excavation contour based on a Gaussian curve.

4. The control system of claim 1, wherein the at least one input is an existing general slope of the surface.

5. The control system of claim 1, wherein the at least one input is a material condition.

6. The control system of claim 1, wherein the capacity of the machine is defined by at least one of a maximum drawbar pull force of the machine.

7. The control system of claim 1, wherein the controller is configured to modify the curve so that a volume of material excavated by following the curve is limited to less than a maximum volume of material movable by the machine.

8. The control system of claim 1, wherein the controller is further configured to modify the curve based upon an entry into and an exit from the surface substantially tangent with the surface.

9. The control system of claim 1, wherein the controller is further configured to modify the curve to includes a slope rate of change being limited to less than a maximum slope rate of change possible with the ground engaging tool.

10. The control system of claim 1, wherein the capacity of the machine is defined by a characteristic of the ground engaging tool, a maximum drawbar pull force of the machine, or a machine travel speed.

11. The control system of claim 1, wherein the capacity of the machine is limited to a percentage of fixed blade load.

12. The control system of claim 11, wherein the percentage of fixed blade load is less than about 80 percent.

13. A method of controlling a machine's work implement, comprising:

providing a machine capacity input to an electronic controller;

providing a worksite condition input to the electronic controller;

generating a desired machine contour of a work surface based on a mathematical curve, the mathematical curve being modified by the machine capacity input and the worksite condition input; and controlling the position of the work implement to produce the desired excavation contour.

14. The method of claim 13, wherein the mathematical curve is a Gaussian curve.

15. The method of claim 13, wherein the mathematical curve has an entry into and an exit from the work surface substantially tangent with the work surface.

16. The method of claim 13, wherein:

the worksite condition input is a slope of the work surface;

a depth of the desired excavation contour increases as the slope of the work surface decrease; and a length of the desired excavation contour decreases as the depth of the desired excavation contour increases.

17. The method of claim 13, wherein:

the worksite condition input is a material condition of the work surface; and a depth of the excavation contour increases as the material of the work surface softens.

* * * * *